US007410296B2

(12) United States Patent
Rogers

(10) Patent No.: US 7,410,296 B2
(45) Date of Patent: Aug. 12, 2008

(54) ELECTRON ABSORPTION APPARATUS FOR AN X-RAY DEVICE

(75) Inventor: Carey Shawn Rogers, Brookfield, WI (US)

(73) Assignee: General Electric Company, Schenectady, NY (US)

( * ) Notice: Subject to any disclaimer, the term of this patent is extended or adjusted under 35 U.S.C. 154(b) by 7 days.

(21) Appl. No.: 11/558,279

(22) Filed: Nov. 9, 2006

(65) Prior Publication Data

US 2008/0112538 A1 May 15, 2008

(51) Int. Cl.
*H01J 35/16* (2006.01)

(52) U.S. Cl. ..... 378/203; 378/142

(58) Field of Classification Search ..... 378/119, 378/121–142, 203; 250/515.1
See application file for complete search history.

(56) References Cited

U.S. PATENT DOCUMENTS 4,309,637 A 1/1982 Fetter
5,689,542 A 11/1997 Lavering et al.
6,115,454 A 9/2000 Andrews et al.
6,215,852 B1 4/2001 Rogers et al.
6,301,332 B1 10/2001 Rogers et al.
6,400,799 B1 6/2002 Andrews
6,519,318 B1 2/2003 Andrews
6,529,579 B1 3/2003 Richardson
6,714,626 B1 3/2004 Subraya et al.
6,980,628 B2 12/2005 Wang et al.
2006/0008057 A1 * 1/2006 Daniel ..... 378/203

* cited by examiner

*Primary Examiner*—Jurie Yun

(57) ABSTRACT

A shield assembly for an x-ray device is disclosed herein. The shield assembly includes a radiation shielding layer comprised of a first material; and a thermally conductive layer attached the radiation shielding layer. The thermally conductive layer is comprised of a second material. The shield assembly also includes an electron absorption layer attached to the radiation shielding layer. The electron absorption layer is comprised of a third material. The electron absorption layer is configured to absorb backscattered electrons.

20 Claims, 4 Drawing Sheets

ELECTRON ABSORPTION APPARATUS FOR AN X-RAY DEVICE

FIELD OF THE INVENTION

This disclosure relates generally to an electron absorption apparatus for an x-ray device.

BACKGROUND OF THE INVENTION

X-ray tubes generally include a cathode and an anode disposed within a vacuum vessel. The cathode is positioned at some distance from the anode, and a voltage difference is maintained therebetween. The anode includes a target track or impact zone that is generally fabricated from a refractory metal with a high atomic number, such as tungsten or any tungsten alloy. The anode is commonly stationary or a rotating disc. The cathode emits electrons that are accelerated across the potential difference and impact the target track of the anode at high velocity. As the electrons impact the target track, the kinetic energy of the electrons is converted to high-energy electromagnetic radiation, or x-rays. The electrons impacting the target track also deposit thermal energy into the anode.

A relatively large percentage of the electrons that strike the target track of the anode backscatter from the anode surface and are therefore sometimes referred to as "backscatter" electrons. The backscattered electrons can re-impact the anode and produce off-focus x-rays that diminish x-ray image quality. This occurs to a high degree in a bi-polar x-ray tube where the anode is maintained at positive potential relative to ground and a significant fraction of backscattered electrons are pulled back to the anode. Additionally, the backscattered electrons can interact with other internal components of the x-ray tube transferring kinetic energy in the form of heat until all their energy is depleted. Excess heat generation adversely affects the durability of the x-ray tube and may also increase expense associated with providing additional cooling capacity.

BRIEF DESCRIPTION OF THE INVENTION

The above-mentioned shortcomings, disadvantages and problems are addressed herein which will be understood by reading and understanding the following specification.

In an embodiment, a shield assembly for an x-ray device includes a radiation shielding layer comprised of a first material; and a thermally conductive layer attached the radiation shielding layer. The thermally conductive layer is comprised of a second material. The shield assembly also includes an electron absorption layer attached to the radiation shielding layer. The electron absorption layer is comprised of a third material. The electron absorption layer is configured to absorb backscattered electrons.

In another embodiment, a shield assembly for an x-ray device includes a radiation shielding layer comprised of a first material. The radiation shielding layer defines a collection surface. The radiation shielding layer is configured to attenuate x-rays. The shield assembly also includes a thermally conductive layer attached the radiation shielding layer. The thermally conductive layer is comprised of a second material. The shield assembly also includes an electron absorption layer attached to the collection surface of the radiation shielding layer. The electron absorption layer is comprised of a third material. The electron absorption layer is configured to absorb backscattered electrons. The shield assembly also includes a passage defined by at least one of the radiation shielding layer, the thermally conductive layer, and the electron absorption layer. The passage generally conforms to the size and shape of an electron beam passing through the passage.

In yet another embodiment, an x-ray device includes a vacuum enclosure; an anode disposed within the vacuum enclosure; and a cathode assembly disposed within the vacuum enclosure. The cathode assembly is configured to transmit an electron beam comprising a plurality of electrons to a focal spot on the anode. The x-ray device also includes a shield assembly disposed within the vacuum enclosure between the anode and the cathode assembly. The shield assembly includes a radiation shielding layer comprised of a first material. The radiation shielding layer defines a generally concave collection surface facing the anode. The shield assembly also includes a thermally conductive layer attached to the radiation shielding layer. The thermally conductive layer is comprised of a second material. The shield assembly also includes an electron absorption layer attached to the collection surface of the radiation shielding layer. The electron absorption layer is comprised of a third material. The electron absorption layer is configured to absorb backscattered electrons.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

Figure 1:
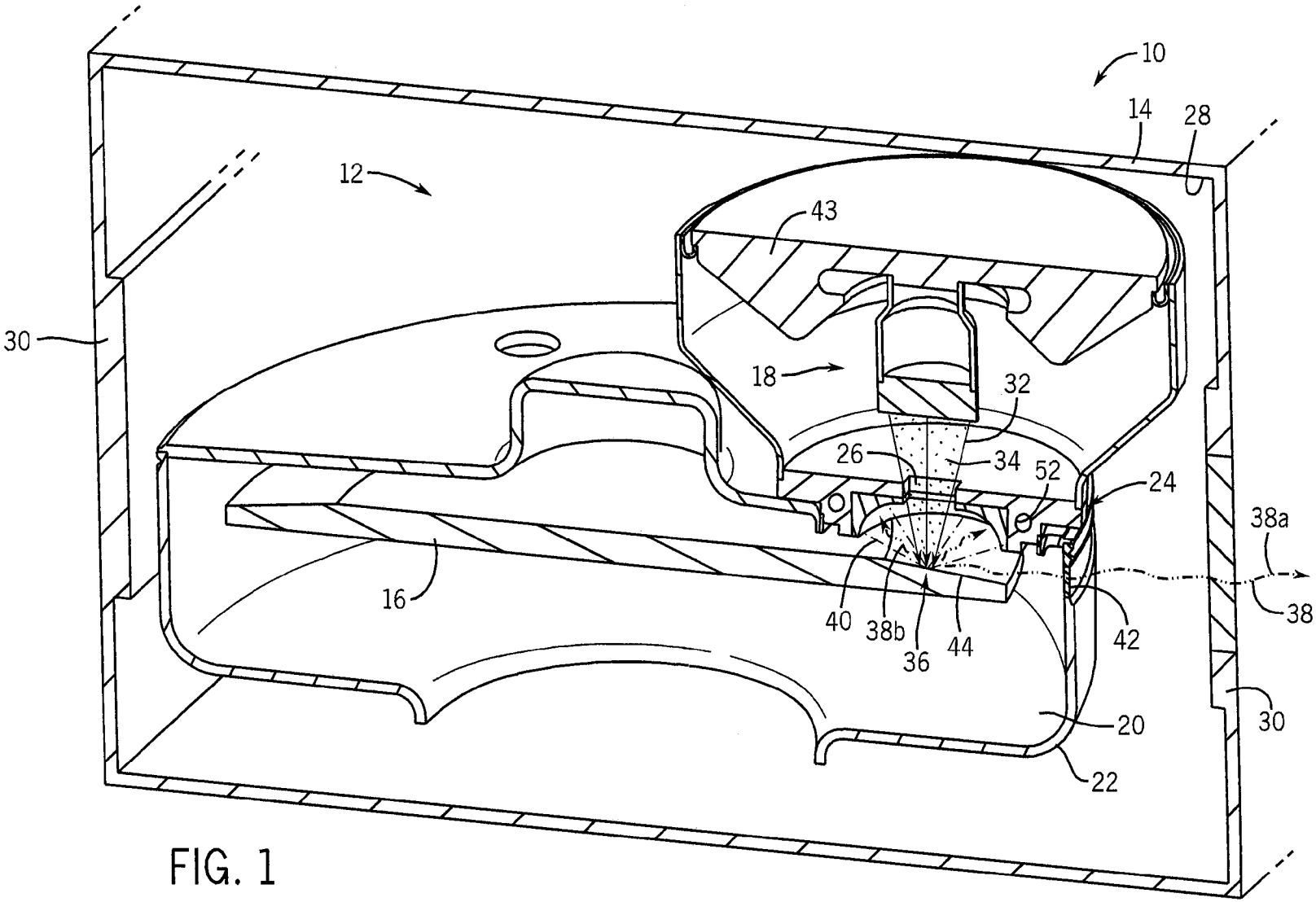
FIG. 1 is a schematic perspective sectional illustration of an x-ray device in accordance with an embodiment.

Referring to FIG. 1, a perspective sectional view of an x-ray device 10 in accordance with an embodiment is shown. The x-ray device 10 includes an x-ray tube insert 12 disposed in the schematically depicted casing 14. The x-ray tube insert 12 includes an anode 16 and a cathode assembly 18 which are at least partially disposed in a vacuum 20 within a vacuum enclosure or vessel 22. A shield assembly 24 defining a passage 26 is interposed between the anode 16 and the cathode assembly 18. The shield assembly 24 is preferably adapted to function as a thermal shield; a radiation shield; and/or a backscattered electron absorber as will be described in detail hereinafter. It should be appreciated that the x-ray device 10 is shown for exemplary purposes, and that the shield assembly 24 may be implemented with other x-ray devices and other x-ray tube configurations. The casing 14 includes a lead based lining 28 adapted to act as a radiation shield. According to one embodiment, the lining 28 includes a band or region 30 of increased thickness positioned at a predetermined location as will be described in detail hereinafter.

The cathode assembly 18 generates and emits an electron beam 32 comprising a plurality of electrons 34 that are accelerated toward the anode 16. The electrons 34 pass through the passage 26 of the shield assembly 24 and strike a focal spot 36 on the anode 16. A first portion of the electrons 34 that impact the anode 16 produce high frequency electromagnetic waves, or x-rays 38, and a second portion of the electrons 34, referred to as "backscattered electrons" 40, deflect or rebound off the anode 16. The x-rays 38 emanate from the focal spot 36 and are emitted in all directions. A portion of the emitted x-rays 38*a* are directed out of a window 42 for penetration into an object such as the body of a patient. The remaining x-rays 38*b* that do not pass through the window 42 are preferably attenuated as will be described in detail hereinafter.

The window 42 is hermetically sealed to the vessel 22 in order to maintain the vacuum 20. The window 42 is transmissive to x-rays, and preferably only allows the transmission of x-rays having a useful diagnostic amount of energy. In accordance with one embodiment, the window 42 may be comprised of Beryllium, however, alternate materials may also be envisioned. Advantageously, by mounting the window 42 to the vessel 22, the window 42 is thermally de-coupled from the shield assembly 24. Thermally de-coupling the window 42 from the shield assembly 24 protects the hermetic seal of the window 42 from thermal stress induced fatigue such that the risk of failure due to vacuum loss is minimized. The window 42 and the exterior of the vacuum vessel 22 may be cooled by a flow of dielectric oil or other acceptable coolant.

The anode 16 is generally disc-shaped and includes a target track or impact zone 44 that is generally fabricated from a refractory metal with a high atomic number such as tungsten or any tungsten alloy. Heat is generated in the anode 16 as the electrons 34 from the cathode assembly 18 impact the target track 44. The anode 16 is preferably rotated so that the electron beam 32 from the cathode assembly 18 does not focus on the same portion of the target track 44 and thereby cause the accumulation of heat in a localized area.

Figure 2:
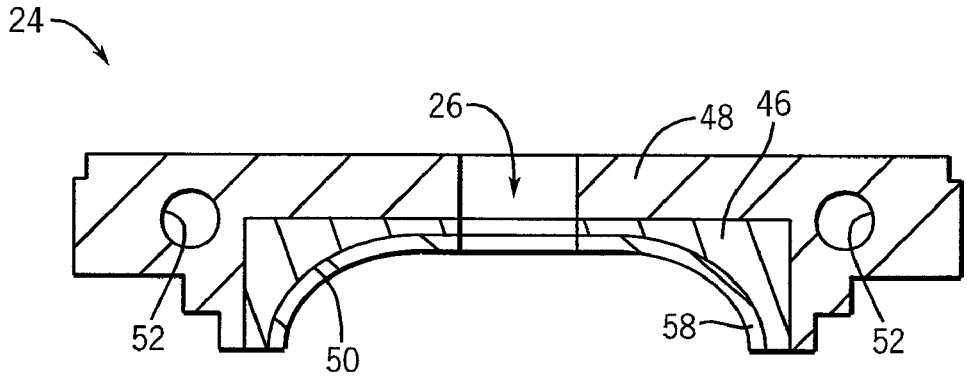
FIG. 2 is a sectional illustration of a shield assembly in accordance with an embodiment.

Referring now to FIG. 2, the shield assembly 24 is shown in more detail. According to one embodiment, the shield assembly 24 may include a radiation shielding layer 46 and a thermally conductive layer 48. The radiation shielding layer 46 defines a collection surface 50 that faces the anode 16 (shown in FIG. 1). According to a preferred embodiment the collection surface 50 is concave in order to increase the effective collection surface area and thereby minimize the localized accumulation of heat, however other shapes may alternatively be implemented. The radiation shielding layer 46 is preferably comprised of a material with a high atomic number such as tungsten or any tungsten alloy, and which has both a high density and high melting point. A material having a high density is important because it is less easily penetrated by x-rays and therefore provides a better radiation shield. A material having a high melting point is important because the backscattered electrons 40 (shown in FIG. 1) generate a lot of heat as they impact the collection surface 50 which may otherwise melt the radiation shielding layer 46 of the shield assembly 24.

The thermally conductive layer 48 of the shield assembly 24 is preferably comprised of a material having high thermal conductivity, low mass, and which bonds well with the radiation shielding layer 46 material. According to an exemplary embodiment, the thermally conductive layer 48 is comprised of copper or copper alloy which meets the aforementioned criteria and is also relatively inexpensive. A high thermal conductivity allows the thermally conductive layer 48 of the shield assembly 24 to evenly and rapidly distribute any accumulated heat and to efficiently transfer such heat toward cooling sources such as, for example, the integral cooling channel 52.

Figure 3:
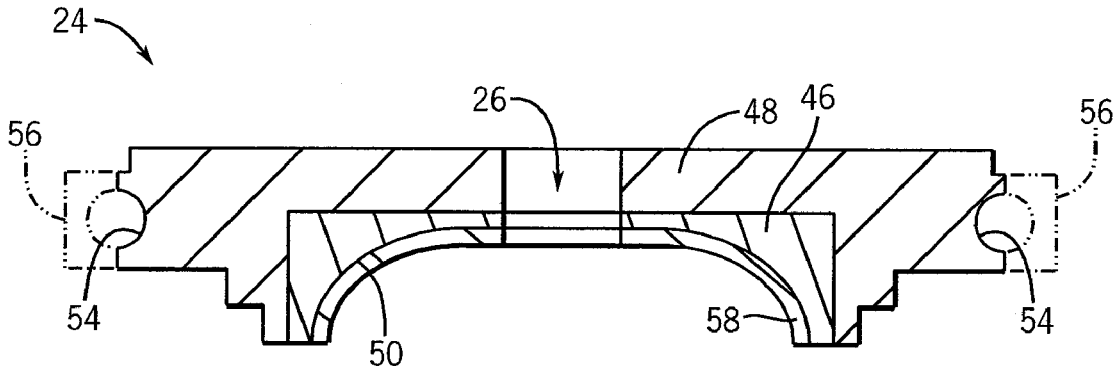
FIG. 3 is a sectional illustration of a shield assembly in accordance with another embodiment.

According to an embodiment shown in FIG. 2, the shield assembly 24 includes the integral cooling channel 52 that is defined by the thermally conductive layer 48. The integral cooling channel 52 receives a liquid coolant (not shown) adapted to absorb heat and thereby cool the shield assembly 24. According to another embodiment shown in FIG. 3, the shield assembly 24 includes a partially integral cooling channel 54. The partially integral cooling channel 54 is so named because it is only partially defined by the thermally conductive layer 48. The remainder of the cooling channel 54 is defined by a separate component such as, for example, the annular member 56 (shown in dashed lines) which can be mounted to the outer periphery of the thermally conductive layer 48 in a conventional manner.

Both the integral cooling channel 52 and the partially integral cooling channel 54 are designed so they do not have any joints or seams exposed to the vacuum 20 (shown in FIG. 1). This provides a more robust design in that liquid coolant (not shown) cannot leak out through a seam or joint and contaminate the vacuum 20. Typically, over the life of a product, thermo-mechanical fatigue can result in failure of formed joints (brazed joints) which would results in loss of vacuum and failure of the x-ray tube. This failure mode can be avoided by not having formed hermetic joints between the device coolant and the vacuum space. For purposes of the present invention, the term cooling channel may include any type of heat transfer augmentation mechanisms such as, for example, fins, porous media, etc.

Referring again to FIG. 2, the shield assembly 24 is preferably fabricated to produce a single device with two different material compositions. According to one embodiment, the shield assembly 24 is produced with a vacuum casting process wherein the radiation shielding layer 46 is pre-fabricated and placed into a mold (not shown), a vacuum is applied to the mold, and thereafter molten material forming the thermally conductive layer 48 is injected into the mold. This approach allows the formation of the integral coolant channel 52 by known casting methods.

The vacuum casting process causes the layers 46 and 48 to "integrally bond" as the molten material solidifies in the mold. For purposes of the present invention, the term "integrally bond" is defined as a generally seamless bond formed by the molecular commingling of different materials such that a single apparatus comprising multiple materials is produced without any braze alloy filler metal or weld joints. The integral cooling channel 52 may be formed during the vacuum casting process in a conventional manner with any known technique. By providing a single integral device, the shield assembly 24 is stronger in that there are no joints or seams that can fail. The one-piece construction is particularly advantageous for the preferred dual-composition shield assembly 24 because the compositions may have significantly different thermal expansion rates and therefore, when exposed to heat, any joints or seams coupling the two materials would be prone to failure.

Alternatively, other known manufacturing processes may be implemented to produce the shield assembly 24 such as, for example, the following. A first alternative process for producing the shield assembly 24 includes hot forging the radiation shielding layer 46 into the thermally conductive layer 48 usually via an intermediary foil (not shown). Hot forging provides a sound metallurgical bond and also enables the implementation a high strength oxide dispersion copper alloy such as GlidCop® which is commercially available from SCM Metal Products, Inc. and which cannot be vacuum cast. GlidCop® is particularly well adapted for use in the thermally conductive layer 48. A second alternative process for producing the shield assembly 24 includes brazing the radiation shielding layer 46 and the thermally conductive layer 48 together. A third alternative process for producing the shield assembly 24 includes explosion welding the radiation shielding layer 46 and the thermally conductive layer 48 together. GlidCop® may also be implemented with both the brazing process and the explosion welding process.

According to one embodiment, the shield assembly 24 includes an electron absorption layer 58 applied to the collection surface 50. The electron absorption layer 58 is designed to absorb or collect the backscattered electrons 40 (shown in FIG. 4). It has been observed that a greater percentage of incident electrons backscatter from materials of higher density such as tungsten, and thereafter can transfer heat to other x-ray tube components or re-impact the anode 16 (shown in FIG. 1) causing off-focus x-rays that degrade the x-ray image. Additionally, backscattered electrons 40 that re-impact the anode 16 can produce secondary backscatter. Therefore, the electron absorption layer 58 may be implemented to absorb or collect a higher percentage of backscattered electrons 40 such that the x-ray image is not degraded.

The electron absorption layer 58 is preferably comprised of a material having a relatively low density and atomic number; a high melting point; a high thermal shock resistance; and a strong bonding capability with the material of the radiation shielding layer 46. The probability that an electron will backscatter out of a material is proportional to the material density and therefore also the atomic number of the material. Accordingly, materials having a relatively low density and atomic number such as, for example, an atomic number less than 50, are well suited to absorbing electrons. The high melting point and bonding capability are preferable in order to prevent the electron absorption layer 58 from degrading under cyclic heat loads and cracking or flaking off.

Some examples of potential electron absorption layer 58 materials include titanium carbide (TiC), boron carbide ($B_4C$), silicon carbide (SiC), and any other electrically conductive carbides, nitrides, or oxides. Additional materials that are well suited for the electron absorption layer 58 include high temperature metals and their alloys such as molybdenum, rhenium, zirconium, beryllium, nickel, titanium, niobium and copper. The previously described electron absorption layer materials are selected to maximize electron collection efficiency, and thereby reduce off-focal radiation and minimize secondary backscatter.

The electron absorption layer 58 can be a solid material that is attached to the radiation shielding layer 46 via brazing or similar process. The electron absorption layer 50 can also be applied as a coating via thermal spray, physical vapor deposition, chemical vapor deposition, or other known processes. The electron absorption layer 58 is preferably applied with a thickness in the range of 0.01-5.0 millimeters which is thick enough to catch the backscattered electrons 40 but not so thick as to impair thermal energy transfer. More generally, the thickness of the electron absorption layer 58 is selectable to optimize electron absorption, thermal energy transfer, and retention (e.g., resistance to cracking or peeling).

The passage 26 is preferably conformal meaning that it conforms to the size and shape of the electron beam 32 (shown in FIG. 1). According to an embodiment of the invention, the size of the passage 26 is just large enough to accommodate the electron beam 32 when it is largest and/or most deflected. By minimizing the size of the passage 26 in the manner described, the shield assembly 24 is better adapted to collect any backscattered electrons 40 (shown in FIG. 5) and to absorb x-rays 38*b* (shown in FIG. 5). In other words, by minimizing the size of the passage 26, fewer backscattered electrons 40 and x-rays 38*b* can escape therethrough. Minimizing the size of the passage 26 also allows the shield assembly 24 to better shield or protect other x-ray tube components such as the cathode assembly 18 and the insulator 43 from evaporated metal and thermal energy. Additionally, a conformal passage can act as a focusing feature that interacts with the electron beam 32 to maintain an optimal size and shape for the focal spot 36 (shown in FIG. 1).

Figure 4:
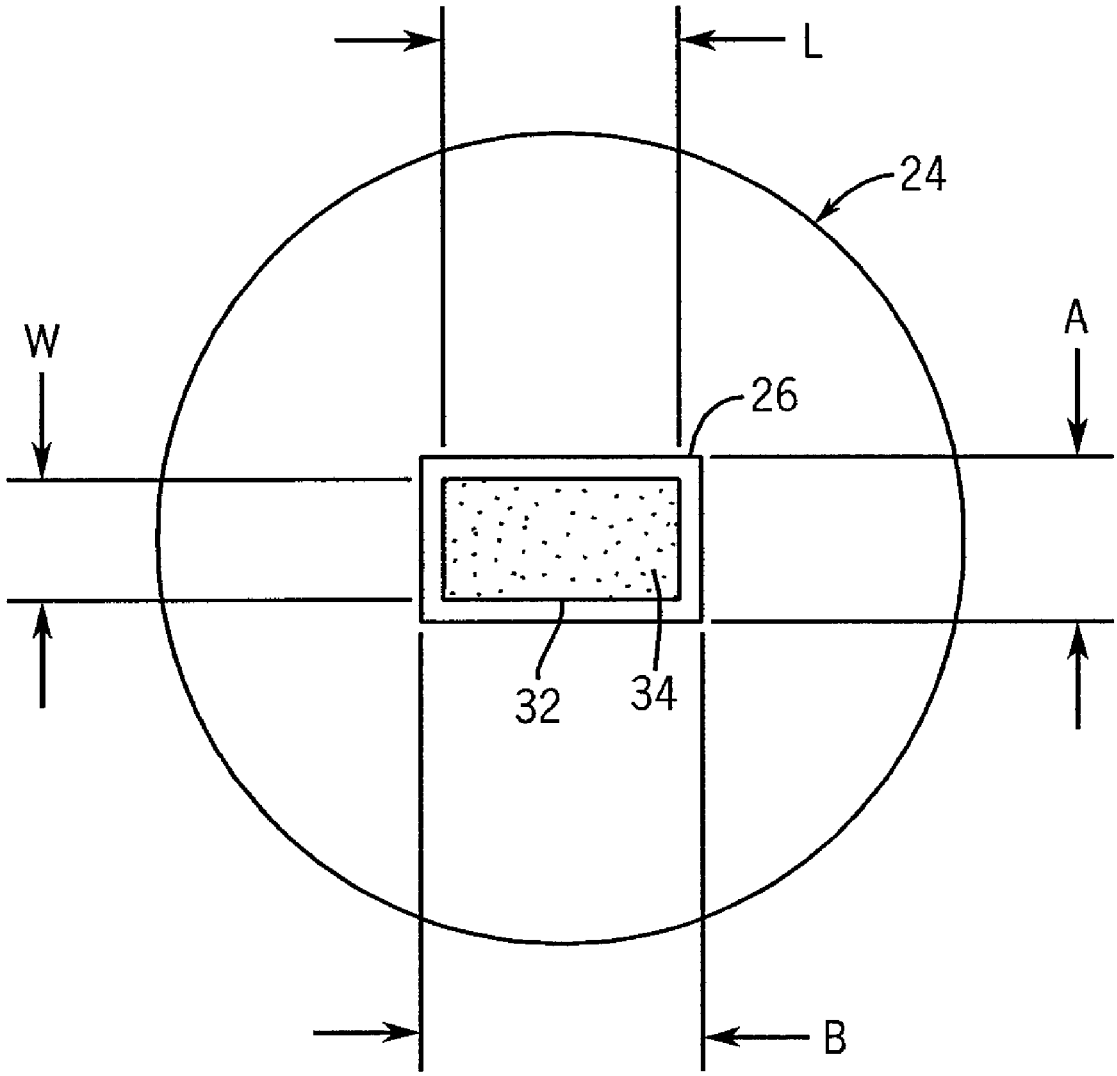
FIG. 4 is a plan view illustration showing an electron beam passing through an exemplary conformal passage.

Referring to FIG. 4, a plan view illustration shows the electron beam 32 passing through an exemplary conformal passage 26 of the shield assembly 24. The electron beam 32 is generally rectangular having a width W and a length L that are defined when the electron beam 32 passes through the passage 26. The passage 26 is therefore also generally rectangular having a width A and a length B. It should be appreciated that, according to the exemplary embodiment of FIG. 4, the width A of the passage 26 is only slightly larger than the width W of the electron beam 32, and the length B of the passage 26 is only slightly larger than the length L of the electron beam 32. While the shield assembly 24 and passage 26 have been shown and described in accordance with a preferred embodiment, it should be appreciated that alternate shield and/or passage configurations may be also envisioned.

Figure 5:
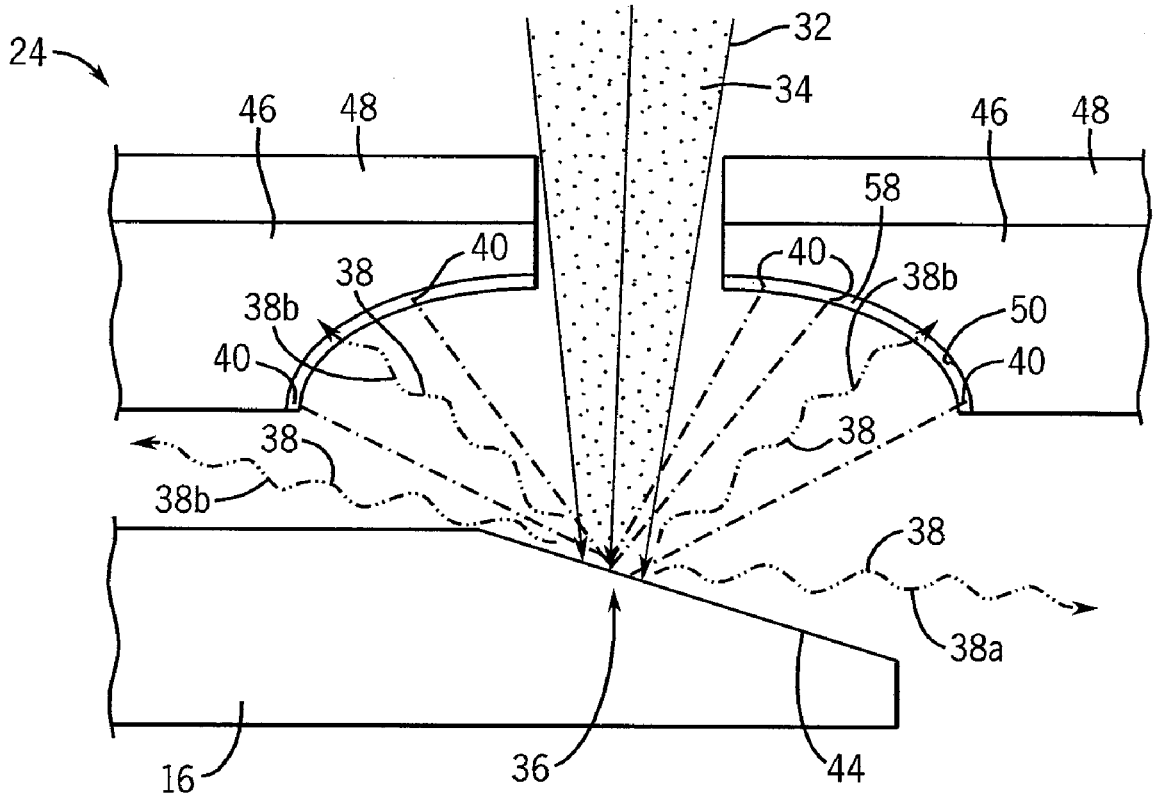
FIG. 5 is a more detailed sectional illustration showing the focal spot of the x-ray device of FIG. 1.

Referring to FIG. 5, the focal spot 36 of the x-ray device 10 (shown in FIG. 1) is shown in more detail. By providing a radiation shielding layer 46 of the shield assembly 24 that is comprised of a material such as tungsten, or a tungsten alloy the collection surface 50 can be positioned in close proximity to the focal spot 36, which is generally very hot, without melting. Advantageously, the close proximity of the collection surface 50 to the focal spot 36 allows the absorption of x-rays 38*b* at or very near their source rather than a more remote location like the casing 14 (shown in FIG. 1).

When the electrons 34 from the cathode assembly 18 (shown in FIG. 1) impact the anode 16, x-rays 38 are emitted in all directions. Only those x-rays 38*a* that are directed out the window 42 (shown in FIG. 1) are useful for imaging, while the remaining x-rays 38*b* must be absorbed to minimize radiation exposure. The x-rays 38*b* which are emitted in a downward direction are mostly absorbed by the anode 16, and the x-rays 38*b* emitted in an upward direction are mostly absorbed by the shield assembly 24. The relatively thick region 30 (shown in FIG. 1) of the lead based lining 28 (shown in FIG. 1) is positioned to collect any x-rays 38*b* that escape between the anode 16 and the shield assembly 24. The remainder of the lead based lining 28 is adapted to collect only those x-rays 38*b* that pass through the anode 16 or the shield assembly 24. As the x-rays 38*b* are primarily absorbed by the anode 16 and the shield assembly 24, the lead based lining 28 can be much thinner than in more conventional designs that do not collect the x-rays at their source. Additionally, in some applications, the amount of radiation escaping between the anode 16 and the shield assembly 24 is sufficiently small that even the relatively thick region 30 can be made thinner than the lead lining of a conventional device.

Reducing the requisite thickness of the lead shield 28 (shown in FIG. 1) considerably reduces the weight of the x-ray device 10 (shown in FIG. 1). This weight reduction is particularly advantageous in computed tomography (CT) applications wherein the x-ray device 10 is rotated rapidly around a patient. More precisely, in a CT application, a weight reduction minimizes the amount of energy required to induce rotation and also minimizes the body loads on the x-ray tube which can introduce stress and thereby diminish reliability.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

I claim:

1. A shield assembly comprising:

a radiation shielding layer for an x-ray device, said radiation shielding layer comprised of a first material;

a thermally conductive layer attached to the radiation shielding layer, said thermally conductive layer comprised of a second material; and an electron absorption layer attached to the radiation shielding layer, said electron absorption layer comprised of a third material, said electron absorption layer configured to absorb backscattered electrons.

2. The shield assembly of claim 1, wherein the electron absorption layer comprises a solid material that is attached to the radiation shielding layer with a brazing process or a welding process.

3. The shield assembly of claim 1, wherein said electron absorption layer comprises a coating applied to the radiation shielding layer with a thermal spray process, a physical vapor deposition process, or a chemical vapor deposition process.

4. The shield assembly of claim 1, wherein said third material has an atomic number less than 50.

5. The shield assembly of claim 1, wherein said third material comprises a material selected from the group consisting of all electrically conductive carbides, nitrides, and oxides.

6. The shield assembly of claim 1, wherein said third material comprises a material selected from the group consisting of molybdenum, rhenium, zirconium, beryllium, nickel, titanium, niobium, copper, and all alloys of these materials.

7. The shield assembly of claim 1, wherein said electron absorption layer is within the range of 0.01 and 5.0 millimeters thick.

8. The shield assembly of claim 1, further comprising a passage defined by at least one of the radiation shielding layer, the thermally conductive layer, and the electron absorption layer, said passage generally conforming to the size and shape of an electron beam passing through the passage.

9. A shield assembly for an x-ray device comprising:

a radiation shielding layer comprised of a first material, said radiation shielding layer defining a collection surface, said radiation shielding layer configured to attenuate x-rays;

a thermally conductive layer attached to the radiation shielding layer, said thermally conductive layer comprised of a second material;

an electron absorption layer attached to the collection surface of the radiation shielding layer, said electron absorption layer comprised of a third material, said electron absorption layer configured to absorb backscattered electrons; and a passage defined by at least one of the radiation shielding layer, the thermally conductive layer, and the electron absorption layer, said passage generally conforming to the size and shape of an electron beam passing through the passage.

10. The shield assembly of claim 9, wherein the electron absorption layer comprises a solid material that is attached to the collection surface of the radiation shielding layer with a brazing process or a welding process.

11. The shield assembly of claim 9, wherein said electron absorption layer comprises a coating applied to the collection surface of the radiation shielding layer with a thermal spray process, a physical vapor deposition process, or a chemical vapor deposition process.

12. The shield assembly of claim 9, wherein said third material has an atomic number less than 50.

13. The shield assembly of claim 9, wherein said third material comprises a material selected from the group consisting of all electrically conductive carbides, nitrides, and oxides.

14. The shield assembly of claim 9, wherein said third material comprises a material selected from the group consisting of molybdenum, rhenium, zirconium, beryllium, nickel, titanium, niobium, copper, and all alloys of these materials.

15. The shield assembly of claim 9, wherein said electron absorption layer is within the range of 0.01 and 5.0 millimeters thick.

16. An x-ray device comprising:

a vacuum enclosure;

an anode disposed within the vacuum enclosure;

a cathode assembly disposed within the vacuum enclosure, said cathode assembly configured to transmit an electron beam comprising a plurality of electrons to a focal spot on the anode; and a shield assembly disposed within the vacuum enclosure between the anode and the cathode assembly, said shield assembly including:

a radiation shielding layer comprised of a first material, said radiation shielding layer defining a generally concave collection surface facing the anode;

a thermally conductive layer attached to the radiation shielding layer, said thermally conductive layer being comprised of a second material; and an electron absorption layer attached to the collection surface of the radiation shielding layer, said electron absorption layer comprised of a third material, said electron absorption layer configured to absorb backscattered electrons.

17. The x-ray device of claim 16, wherein said shield assembly includes a passage defined by at least one of the radiation shielding layer, the thermally conductive layer, and the electron absorption layer, said passage adapted to accommodate the electron beam, said passage generally conforming to the size and shape of the electron beam as the electron beam passes through the passage.

18. The x-ray device of claim 16, wherein said third material has an atomic number less than 50.

19. The x-ray device of claim 16, wherein said electron absorption layer is within the range of 0.01 and 5.0 millimeters thick.

20. The x-ray device of claim 16, wherein said third material comprises a material selected from the group consisting of all electrically conductive carbides, nitrides, and oxides.

* * * * *